United States Patent [19]

Jansen et al.

[11] Patent Number: 4,900,067

[45] Date of Patent: Feb. 13, 1990

[54] RETRIEVABLE PACKOFF WITH AN EMBEDDED FLEXIBLE, METALLIC BAND

[75] Inventors: Martin B. Jansen, Agoura Hills; John Pettit, Camarillo, both of Calif.

[73] Assignee: Vetco Gray Inc., Houston, Tex.

[21] Appl. No.: 384,070

[22] Filed: Jul. 21, 1989

Related U.S. Application Data

[63] Continuation of Ser. No. 727,492, Apr. 26, 1985, abandoned.

[51] Int. Cl.[4] ..... F16L 21/00

[52] U.S. Cl. ..... 285/140; 277/235 R; 277/166; 277/9.5; 285/338; 166/86

[58] Field of Search ..... 285/139, 140, 196, 147, 285/338, 351, 910, 917, 141, 142, 143, 348; 166/87, 88, 89, 382; 277/9.5, 235 R, 164, 166

[56] References Cited

U.S. PATENT DOCUMENTS

| | | | |
|---|---|---|---|
| 927,874 | 7/1909 | Robinson | 277/235 R |
| 1,643,119 | 9/1927 | Hartman | 277/235 R |
| 2,002,122 | 5/1935 | McWane | 277/235 R |
| 2,544,324 | 3/1951 | Jepson | 285/140 |
| 2,723,721 | 11/1955 | Corsette | 277/235 R |
| 3,490,777 | 1/1970 | Emmerson | 277/235 R |
| 3,492,026 | 1/1970 | Ahlstone | 285/18 |
| 3,524,653 | 8/1970 | Vincent | 277/235 |
| 3,561,527 | 2/1971 | Nelson | 285/142 |
| 3,570,259 | 3/1971 | Thaxton | 277/164 |
| 3,572,627 | 3/1971 | Jones | 277/235 R |
| 3,591,125 | 7/1971 | Lewis | 277/235 |
| 3,797,864 | 3/1974 | Hynes et al. | 285/140 |
| 4,007,904 | 2/1977 | Jones | 277/235 R |
| 4,098,516 | 7/1978 | Murman | 277/235 R |
| 4,324,422 | 4/1982 | Rains et al. | 285/140 |
| 4,447,037 | 5/1984 | Huey et al. | 277/235 R |
| 4,460,149 | 7/1984 | Schaeper et al. | 277/235 R |
| 4,465,097 | 8/1984 | Suzuki et al. | 277/235 R |
| 4,488,740 | 12/1984 | Baugh et al. | 285/917 |
| 4,521,040 | 6/1985 | Slyler | 285/338 |
| 4,550,782 | 11/1985 | Lawson | 285/140 |

FOREIGN PATENT DOCUMENTS

| | | | |
|---|---|---|---|
| 6891 | of 1887 | United Kingdom | 285/910 |
| 566329 | 12/1944 | United Kingdom | 285/910 |

*Primary Examiner*—Gary L. Smith
*Assistant Examiner*—Eric K. Nicholson
*Attorney, Agent, or Firm*—James E. Bradley

[57] ABSTRACT

A packoff (10) with an elastomeric seal ring (16) interposed between two metallic seal rings (12) and (14) with retrievable characteristics in the form of a relatively thin apertured curved cylindrical band (50) extending between the two metallic seal rings (12) and (14). The metallic band (50) is such that it does not interfere with the deformability of the elastomeric material when the packoff is set, but provides a mechanical connection between the upper and lower metallic rings (12) and (14) thus providing the packoff with retrievable capabilities.

6 Claims, 3 Drawing Sheets

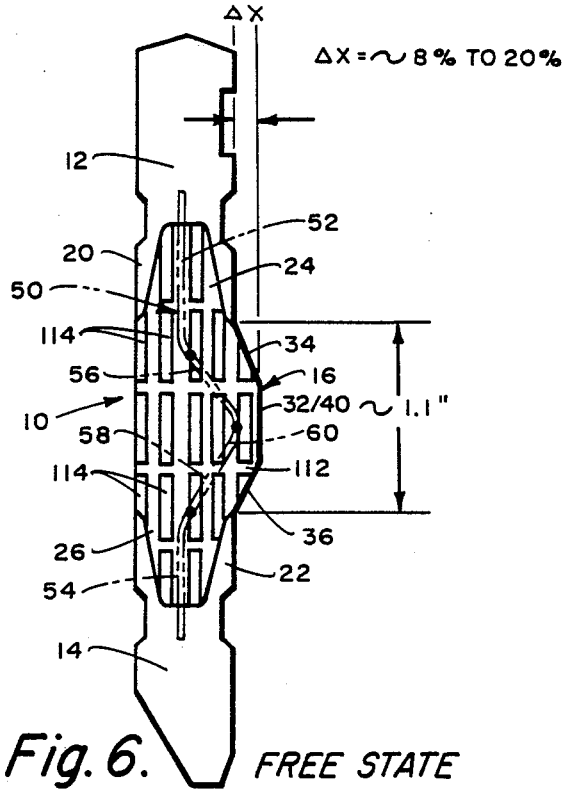
Fig. 6. FREE STATE
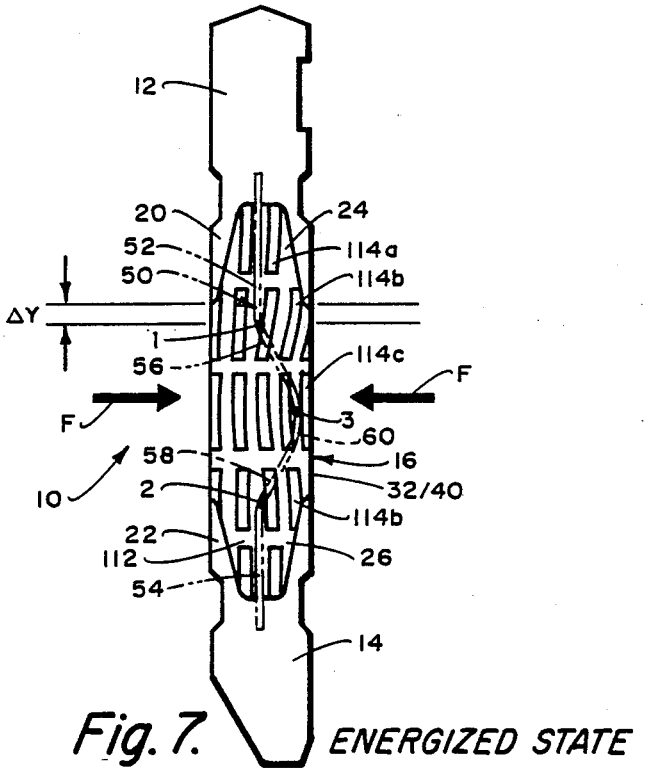
Fig. 7. ENERGIZED STATE

RETRIEVABLE PACKOFF WITH AN EMBEDDED FLEXIBLE, METALLIC BAND

This application is a continuation of application Ser. No. 727,492 filed Apr. 26, 1985, now abandoned.

BACKGROUND OF THE INVENTION

This invention relates to seals and seal assemblies, often referred to as packoffs and packoff assemblies, respectively, for sealing the annular space, often referred to as an annulus between a wellhead casing hanger and the surrounding cylindrical wall of a wellhead. This invention is specifically directed to improving such packoff and packoff assemblies so that packoff may be retrieved from the annulus after having been set, i.e., placed in position of sealing engagement between the casing hanger wall and the surrounding cylindrical wall.

For an example of a type of packoff and packoff assembly to which this invention relates, attention is directed to the U.S. Pat. No. 3,797,864 of Hynes and Ortolon, and to U.S. Pat. Application of Slyker and Pettit Ser. No. 419,270, filed Sept. 17, 1982, now U.S. Pat. No. 4,521,040. These patents illustrate a packoff comprising an elastomeric ring interposed between two metallic seal rings. Each metallic seal ring has a pair of lips extending toward the elastomeric material so that on compression of the elastomeric material the lips are forced outwardly toward the surrounding walls.

It is recognized that a packoff of the type disclosed in these patents perform as anticipated when set, but often their retrieval is required. To retrieve such packoffs, the packoff assembly is pulled out of the annulus, i.e., pulled upwardly back out of the well by pulling on the upper metallic seal ring. This pulling often resulted in a rupturing or tearing of the elastomeric material leaving half, or some part thereof, together with the lower metallic seal ring within the annulus. When this happens, when the remaining parts of the packoff cannot easily be retrieved, other sealing arrangements must be made.

Recognizing also that the use of the elastomeric type seal is the best approach to packoff off the annulus, numerous attempts have been made in the past to provide a means by which such a packoff can be retrieved.

One such attempt comprised a plurality of vertically disposed bolts extending through the upper and lower metallic seal rings and through the vertical center portion of the elastomeric material with sufficient play between the lower seal ring and the bolts to allow the bolts to move axially relative to the lower metallic seal ring when the packoff was set in the annulus. This allowed the elastomeric material to deform and allowed the distance between the metallic seal rings to change. When the packoff was set, however, it was found that, in the areas immediately surrounding the bolts, the elastomeric material differed in its deformation than in the areas between the bolts. This resulted in different sealing capabilities near the areas of the bolts from that of the other areas. Thus, while this prior art attempt solved the problem of retrievability, the sealing capability of the packoff was compromised, i.e., the sealing capabilities around the packoff varied circumferentially around the packoff and provided leak paths.

Another attempt to make such a packoff retrievable was to use wires instead of bolts, but the result was the same.

Another approach to providing a packoff with retrievable capabilities is the use of a solid, cylindrical band disposed vertically midway of the elastomeric material and connected in some suitable manner between an upper and a lower metallic seal ring so that a pull on the upper metallic ring, pulled the lower metallic ring without stress on the elastomeric material. This approach divided the elastomeric material into two separate elastomeric seals: one adjacent the casing hanger and one adjacent the surrounding well housing wall. In this approach, in addition to having variable elastomeric distortion since the elastomeric material was no longer a single body of material, the inner solid metallic ring provided four possible leak paths instead of two in the annulus one leak path adjacent surrounding the wellhead wall, one on each side of the metallic band and one adjacent the sealing wall of the casing hanger. Again, while the solid band approach solved the retrievable problem, it compromised the capabilities of the packoff to seal the annulus.

Still another approach for providing a packoff with retrievable capabilities is shown in the U.S. Pat. No. 4,324,422, of Rains and Reimert in which a pair of metallic rings with dog-like portions, i.e., overlapping fingers, were imbedded in the elastomeric material and arranged in a lost motion connection between the fingers. The lost motion connection allowed deformation of the elastomeric material when the packoff was set and became interlocking when the packoff was to be retrieved by providing a mechanical connection between the upper and lower metallic seal rings when the fingers engaged one another in an upward pull on the upper seal ring. This approach, however, while again solving the retrieval problem, compromised the sealing capability of the packoff. The metallic sleeves and fingers, together with the lost motion connection, interfered with the deformation characteristics of the elastomeric material. Stated another way, the elastomeric material did not deform as a single solid body of elastomeric material would have deformed, when set.

Another type of packoff which is part of the prior art because it has retrievable capabilities is one utilizing upper and lower metallic rings with a deformable metallic band therebetween and surrounded by a plurality of elastomeric rings. The deformable metallic band is in the form of a plurality of V's laid sidewards having the elastomeric rings at the apex of the V's. When set, the ends of the legs and the apices of the V's and, together with the elastomeric rings, engage the annulus side walls to form a seal. This packoff, however, relies heavily on the metal-to-metal sealing engagement against the annulus walls. The use of several elastomeric rings, instead of one body of elastomeric material with different deformation characteristics, may provide several leakage paths. Nonetheless, a pull on the upper metallic ring will retrieve the packoff since the deformable metallic band is connected to the lower metallic ring. Other disadvantages in this type of packoff are the severe difficulties in coping with even small eccentricities between the casing hanger and wellhead housing. This type of seal also needs a very high amount of force to set, which is supplied by undesirable torque multiplication gears.

Another packoff which has retrievable capabilities is that shown in the U.S. Pat. No. 3,561,527 of Nelson which an elastomeric ring between two upper and lower seal rings included a centrally located, vertically oriented serpentine shaped band imbedded in the elastomeric material. The connection of the serpentine band to both the upper and lower seal rings made the packoff retrievable, but in view of the size and thickness of the serpentine band, like the packoff of the U.S. Pat. No. 4,324,422 of Rains and Reimert, supra, the metallic serpentine band interfered with the deformation characteristics of the elastomeric material and reduced the sealing capabilities of the packoff.

It is therefore an object of this invention to provide a packoff similar to the prior art utilizing two metallic seal rings with a ring of elastomeric material therebetween, but with retrieval capabilities which will not interfere or compromise the sealing capabilities of the elastomeric material.

SUMMARY OF THE INVENTION

The packoff and packoff assembly of this invention which obtains the foregoing object comprises a packoff with an elastomeric seal ring interposed between two metallic seal rings with means for providing the packoff with retrievable characteristics in the form of a relatively thin curved cylindrical band provided with long, narrow slots which form a plurality of vertical bands extending between the two metallic seal rings. In the embodiment disclosed, the elastomeric ring is thicker than both the metallic rings and the annulus to be sealed and when forced into the annulus, the annulus is sealed by the elastomeric ring. The two metallic seal rings have lips which overlap the elastomeric material and are forced outwardly by the deformation of the elastomeric material. The metallic band is such that it does not interfere with the deformability of the elastomeric material, but provides a mechanical connection between the upper and lower metallic seal rings thus providing the packoff with retrievable capabilities. The vertical bands provide flexibility in a radial and axial direction and reaction contact surfaces against which the elastomeric material reacts.

It will be apparent to those skilled in the art after a study of the following drawing and Detailed Description that the thin vertical bands which provide flexibility in a radial direction only, provide a tension member function and, due to large circumferential reaction surfaces, allow the deformation of the elastomeric material to drive the deflection of the vertical bands, thus not diminishing the sealing capability of the elastomeric material.

BRIEF DESCRIPTION OF THE DRAWINGS

FIGS. 6 and 7 are schematic illustrations of a cross-section in elevation of the packoff with an overlay showing the deformation of the elastomeric material by movement and distortion of the overlay and the location of the metallic band with respect thereto; FIG. 6 illustrates the free state of the packoff and FIG. 7 illustrates the energized state of the packoff in the annulus.

DETAILED DESCRIPTION

Figure 1:
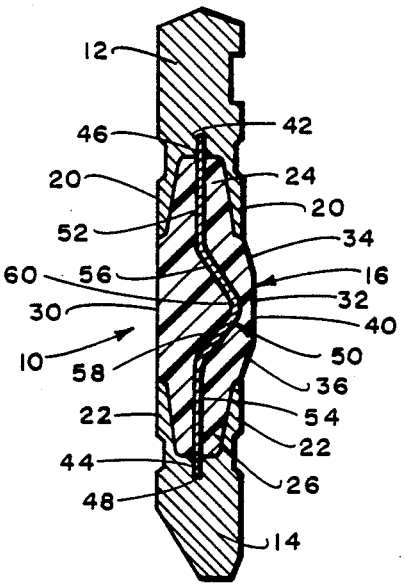
FIG. 1 is a cross-sectional view in elevation of a packoff constructed in accordance with the invention.

FIG. 1 illustrates a packoff 10 constructed in accordance with this invention and shown to comprise an upper metallic cylindrical seal ring 12, a lower metallic cylindrical seal ring 14 and a ring 16 of elastomeric material interposed therebetween.

The upper metallic seal ring is provided with a pair of integral downwardly extending seal/anti-extrusion lips 20. The lips are tapered with the thickest portions adjacent the main portion of the seal ring and tapering to a relatively thin wall at their lower end.

Similarly, the lower metallic seal ring has upwardly extending tapered seal/anti-extrusion lips 22 of the same contour, in cross section, as those of the upper metallic seal ring.

The elastomeric seal ring 16 extends into the cavities 24 and 26 between the lips of both the upper and lower seal ring and is provided with an outer wall 30 which is co-extensive with the outer walls of the seal rings and an inner wall 32 which extends outwardly beyond the inner walls of the metallic seal rings. The inner wall 32 is formed with two tapered portions 34 and 36 immediately adjacent the termination of the upper and lower lips and a flat intermediate portion 40 parallel to the inner surfaces of the metallic seal rings and thus form a bulge in the wall 32 midway between the upper and lower lips.

The upper and lower metallic seal rings 12 and 14 each have vertical slots 42 and 44 located midway the thickness of the metallic seal rings into which the upper and lower section 46 and 48 of a metallic band 50 is positioned and suitably fixed, as by welding, to form a permanent bond to the upper and lower metallic seal rings, respectively. In the cross-section of FIG. 1 the metallic band 50 is straight a distance substantially equal to the length of the tips as at 52 and 54, but then curves toward the inner wall as at 56 and 58 to form a bulge 60 with its maximum extent adjacent the central portion of the inner wall 32.

Figure 2:
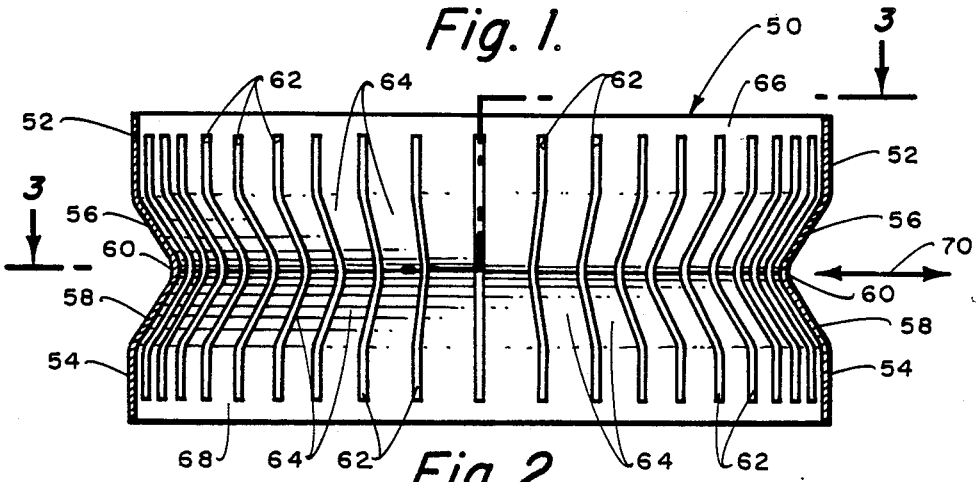
FIG. 2 is cross-sectional view in elevation of the metallic band or ring for imbedding in the elastomeric material of the packoff.
Figure 3:
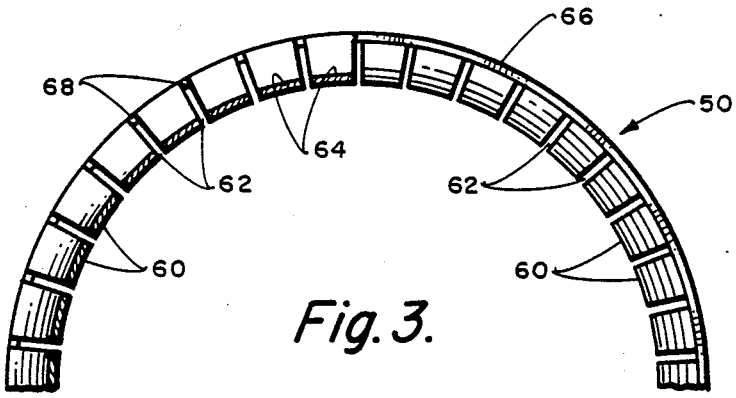
FIG. 3 is both a top and sectional view of the band, taken along 3—3 of FIG. 2, to more clearly illustrate the details of the band.

This band 50 gives the packoff its retrievable capabilities by forming a tension member between the upper and lower metallic sealing rings and is illustrated in more detail in FIGS. 2 and 3.

The left portion of FIG. 2 is a cross-sectional view similar to the view of FIG. 1, but the remainder of the Figure shows the band 50 as having a plurality of spaced apart, relatively narrow, vertical slots 62 which form vertical metallic bands 64 therebetween to allow the elastomeric material to flow therethrough when the elastomeric material is molded into the configuration as shown in FIG. 1 and extend essentially the width of the band 50 and into both straight portions 52 and 54 to also form solid bands 66 and 68 of metal at both the top and bottom of the band. The vertical metallic bands 64, on the other hand, give the band 50 flexibility in its middle and in the radial direction as represented by the arrow 70 and, thus, allow the vertical metallic bands to be deflected by the elastomeric material so that the elastomeric material can assume its normal "optimal-for-sealing" configuration. This material of the band in one application is a high strength, low alloy ASTM-4130, approximately 0.030 thick.

Figure 4:
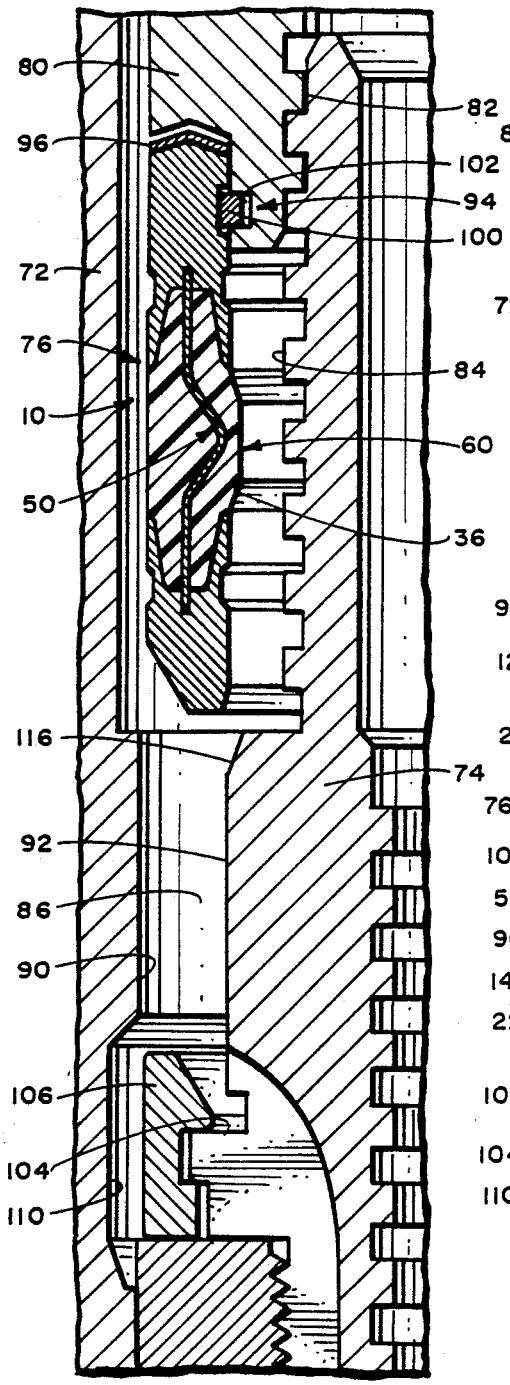
FIG. 4 is a cross-sectional view in elevation of a packoff assembly in unenergized condition shown in a typical casing hanger and surrounding wellhead housing.
Figure 5:
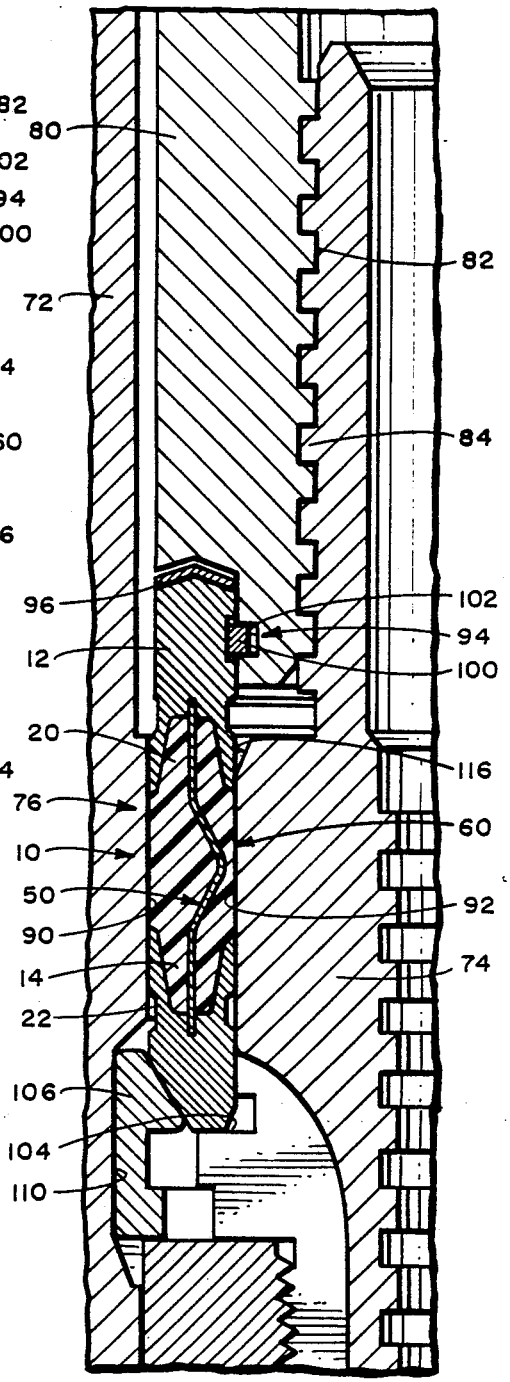
FIG. 5 is a view similar to FIG. 4, but with the packoff in a pressure energized or set condition.

FIGS. 4 and 5 illustrate a typical arrangement within a wellhead housing 72 with a casing hanger 74 supported on a profile (not shown). Typically, the casing hanger supports a string of casing, as shown by way of example in the U.S. Pat. Nos. 3,492,026 and 3,797,864, as well as in some of the patents, supra. A packoff assembly 76 typically includes the packoff 10 and a packoff drive nut 80 which supports the packoff 10. The packoff drive nut 80 is shown with internal threads 82 engaging external threads 84 on the upper end of the casing hanger such that rotation of the packoff drive nut 80 will thread the packoff assembly downward into the annulus 86 formed between the inner bore wall 90 of the wellhead housing and the sealing surface 92 on the casing hanger. To allow the packoff drive nut 80 to rotate without rotation of the packoff 10, the packoff assembly 80 has a swivel connection 94 and a thrust bearing 96. The swivel connection comprises a split retainer ring 100 mounted in complementary grooves 102 in the packoff drive nut 80 and upper metallic seal ring.

FIG. 5 shows the packoff 10 driven into the annulus 86 and the elastomeric ring 16 compressed due to a reduced radial distance of the annulus thereby forming a pressure seal in the annulus. The packoff 10 is driven further down against the friction force of the annulus walls, and the upper and lower lips 20 and 22 tend to part to form seals/anti-extrusion barriers after the lower metallic ring 14 abuts a shoulder 104 located on the casing hanger body 74, and also engages a split ring 106 which is held on the casing hanger into a groove 110 in the wellhead in order to lock the casing hanger 74 in the wellhead. At this time the packoff is considered set.

For a more complete explanation of how the tapered lips 20 and 22 react during the movement of the packoff downwardly into the annulus, reference is made to the Slyker and Pettit Patent, supra. This patent also sets out the amount of thickness of the elastomeric ring 16 at the center, i.e., wall 32/40 as compared to the thickness of the upper and lower metallic seal rings 12 and 14 and how this improved the sealing capabilities of the packoff. The thickness as stated therein ranged from 8% to 20% greater than the thickness of the metallic seal rings. However, the reaction of the elastomeric ring 16 during this downward travel or its final set will be discussed in connection with FIGS. 6 and 7 to which attention is now directed. It will be apparent that utilizing the technique discussed in these latter Figures, the natural flow of the elastomeric material, i.e., deformation, is not interfered with by the presence of the band 50 and it is to this end that this invention is directed.

FIGS. 6 and 7 illustrate the packoff 10 of this invention with FIG. 6 corresponding to the packoff 10 as shown in FIGS. 1 and 4, and FIG. 7 corresponding to the packoff 10 as shown in FIG. 5. To illustrate the deformation of the elastomeric material of the ring 16 when the packoff is both in its unset and set condition, an overlay 112 has been placed over the elastomeric ring 16 and, thus, in FIG. 6 the overlay 112 comprises a gridwork of a plurality of rectangles 114 disposed in rows and columns in cross-sectional view with the band 50 shown only in phantom to illustrate the manner of which the curvature of the band was determined. In this Figure, the rectangles 114 are uniformly distributed and undistorted.

FIG. 7 illustrates the packoff 10 in its set condition, the side wall 32/40 near the casing hanger has been compressed so that the side wall 32/40 is now coextensive with the thickness of the upper and lower metallic sealing rings 12 and 14. This compression is represented by the notation delta X. The reaction force of the walls of the annulus 86 is represented by the arrows F.

Also, as shown in FIG. 7, as the packoff 10 enters the narrower annulus 86, the tapered surface 36 engages the tapered inner wall 116 (FIGS. 4 and 5) with an initial reaction of the elastomeric material to compress, but since the total volume of material remains the same, the packoff 10 elongates slightly. This is represented by the notation delta Y.

The total compression (deformation) of the packoff as shown in FIG. 7 is illustrated by a distortion of the rectangles 116. The rectangles **114*a* within the confines 24 and 26 of the lips 20 and 22 are undistorted, but the rectangles 114*b* immediately above and below the upper lips 20 and 22 undergo a major transformation. This illustrates the area of maximum twist of the elastomeric material by the distortion of the upper and lower portions of the rectangles, especially those rectangles 114*b* nearest the compressed inner wall 32. The rectangles 114*c* near the height of the bulge 60**, on the other hand, have become thinner, horizontally, and closer together.

Utilizing the gridwork illustrating the elastomeric distortion as shown in FIG. 7, the curvature of the band was selected. The curvature is such that the band's natural deflection when it is compressed from the casing hanger side and elongated is similar to the material deformation of the elastomeric material when installed in the annulus. Within the confines of the lips, i.e. areas 24 and 26, the band 50 was formed straight, i.e. portions 52 and 54, and immediately curving at 56 and 58 toward the bulge, represented at points 1 and 2 until the height of the bulge 60 reaches a point 3, i.e. maximum extent. Utilizing that distortion of the elastomeric material the curvature of the band was driven into the configuration as represented by FIG. 6. Thus, the profile of the band 50 in FIG. 6 conforms to the profile of the band 50 in FIGS. 1, 3 and 4.

From the foregoing it can be seen that the concept of providing a band such as 50 which as nearly as possible conforms to the deformation of the elastomeric material when the packoff is set provides the packoff with retrievable capabilities yet does not interfere with the deformation characteristics of the elastomeric material. In other words, the result of the study was that a band 50 was configured to react to the elastomeric material in such a way that latter's deformation characteristics remain the same. That is to say, the elastomeric material was free to deform, as if there was no metallic band in-between. Nonetheless, when it is decided to retrieve the packoff 10, for whatever reason, the same metallic band 50 provided the necessary mechanical connection between the upper and lower metallic seal rings to make retrievability possible.

We claim:

1. A packoff for an annular space between a casing hanger cylindrical wall and a wellhead housing cylindrical bore wall, comprising in combination:

an upper metallic seal ring;

a lower metallic seal ring;

an elastomeric seal ring having an upper end secured to the upper metallic seal ring and a lower end secured to the lower metallic seal ring, the elastomeric seal ring having an inner wall portion which initially protrudes radially inward past the metallic seal rings prior to entry into the annular space, the inner wall portion having an initial diameter that is less than the diameter of the casing hanger cylindrical wall prior to entry into the annular space, so as to cause deformation and sealing engagement of the elastomeric seal ring in the annular space, said deformation causing elongation of the elastomeric seal ring, forcing the metallic seal rings axially apart from each other; and a metallic band embedded within the elastomeric seal ring, having upper and lower ends connected to the metallic seal rings, the metallic band having a curved section intermediate its ends which curves in vertical cross-section radially inward, the band having vertical slots extending around its circumference and being sufficiently thin so as to flex and elongate when the metallic seal rings move apart from each other as the packoff enters the annular space, the metallic band retaining the lower metallic seal ring and the elastomeric seal ring with the upper metallic seal ring in the event that the packoff is removed from the annular space.

2. A packoff for an annular space between a casing hanger cylindrical wall and a wellhead housing cylindrical bore wall, comprising in combination:

an upper metallic seal ring;

a lower metallic seal ring;

an elastomeric seal ring having an upper end secured to the upper metallic seal ring and a lower end secured to the lower metallic seal ring, the elastomeric seal ring having an inner wall portion which has a radial thickness that is initially greater than the radial thickness of the metallic seal rings and initially protrudes radially inward past the metallic seal rings prior to entry into the annular space, the inner wall portion having an initial diameter that is less than the diameter of the casing hanger cylindrical wall prior to entry into the annular space, so as to cause deformation and sealing engagement of the elastomeric seal ring in the annular space, said deformation causing elongation of the elastomeric seal ring, forcing the metallic seal rings axially apart from each other;

a metallic band embedded within the elastomeric seal ring, having upper and lower ends connected to the metallic seal rings, the metallic band having a curved section intermediate its ends which curves in vertical cross-section radially inward, the band having vertical slots extending around its circumference and being sufficiently thin so as to flex and elongate when the metallic seal rings move apart from each other as the packoff enters the annular space, the metallic band retaining the lower metallic seal ring and the elastomeric seal ring with the upper metallic seal ring in the event that the packoff is removed from the annular space;

bendable downward extending lips on the upper metallic seal ring; and bendable upward extending lips on the lower metallic seal ring, the downward extending and upward extending lips bending radially outward into engagement with the cylindrical wall and bore wall when a downward setting force is applied.

3. A packoff for an annular space between a casing hanger cylindrical wall and a wellhead housing cylindrical bore wall, comprising in combination:

an upper metallic seal ring having a lower end and a circular vertical slot formed therein;

a lower metallic seal ring having an upper end and a circular vertical slot formed therein;

an elastomeric seal ring having an upper end secured to the lower end of the upper metallic seal ring and a lower end secured to the upper end of the lower metallic seal ring, the elastomeric seal ring having an inner wall portion which initially has a thickness that is greater than the thickness of the metallic seal rings and which initially protrudes radially inward past the metallic seal rings prior to entry into the annular space, the inner wall portion having an initial diameter that is less than the diameter of the casing hanger cylindrical wall prior to entry into the annular space, so as to cause deformation and sealing engagement of the elastomeric seal ring in the annular space, said deformation causing slight elongation of the elastomeric seal ring, forcing the metallic seal rings axially apart from each other;

a metallic band embedded within the elastomeric seal ring, having upper and lower ends secured within the slots of the metallic seal rings, the metallic band having a curved section intermediate its ends which curves in vertical cross-section radially inward, the band having vertical slots extending around its circumference and being sufficiently thin so as to flex and elongate when the metallic seal rings move apart from each other as the packoff enters the annular space, the metallic band retaining the lower metallic seal ring and the elastomeric seal ring with the upper metallic seal ring in the event that the packoff is removed from the annular space;

bendable downward extending lips on the upper metallic seal ring; and bendable upward extending lips on the lower metallic seal ring, the downward extending and upward extending lips bending radially outward into engagement with the casing hanger cylindrical wall and bore wall when a downward setting force is applied.

4. The packoff as claimed in claim 3 wherein the elastomeric ring has an initial thickness that exceeds the thickness of the elastomeric seal rings by between 8% and 20%.

5. The packoff as claimed in claim 3 wherein the slots of the band are elongated apertures which define thin vertical bands.

6. A method of sealing an annular space between a casing hanger cylindrical wall and a wellhead housing cylindrical bore wall, comprising in combination:

providing a packoff with an upper metallic seal ring and a lower metallic seal ring;

securing an upper end of an elastomeric seal ring to the upper metallic seal ring and a lower end of the elastomeric seal ring to the lower metallic seal ring;

providing the elastomeric seal ring with an inner wall portion which initially protrudes radially inward past the metallic seal rings prior to entry into the annular space, and providing the inner wall portion with an initial diameter that is less than the diameter of the casing hanger cylindrical wall prior to entry of the packoff into the annular space;

providing a metallic band an positioning it within the elastomeric seal ring with upper and lower ends of the metallic band connected to the metallic seal rings;

providing the metallic band with a curved section intermediate its ends with curves in vertical cross-section radially inward;

providing the band with vertical slots extending around its circumference; and lowering the packoff into the annular space, with the inner wall portion of the elastomeric seal ring contacting the casing hanger cylindrical wall, causing deformation and sealing engagement of the elastomeric seal ring in the annular space and causing elongation of the elastomeric seal ring, forcing the metallic seal rings axially apart from each other, the metallic band flexing and elongating during said elongation of the elastomeric seal ring.

* * * * *

UNITED STATES PATENT OFFICE

CERTIFICATE OF CORRECTION

Patent No. 4,900,067 Dated 02/13/90

Inventor(s) JANSEN, ET AL

It is certified that error appears in the above-identified patent and that said Letters Patent is hereby corrected as shown below:

At Column 1, Line 31, "a" should be deleted;

At Column 1, Line 31, "packoff" should be--packoffs--;

At column 2, Line 15, a semicolon should follow "annulus";

At column 2, line 46, a comma should follow the word "sidewards";

At column 8, line 60, "an" should be--and--;

At column 8, line 65, "with" should be--which--.

Signed and Sealed this

Twenty-eighth Day of April, 1992

*Attest:*

HARRY F. MANBECK, JR.

*Attesting Officer*

*Commissioner of Patents and Trademarks*